US006058670A

United States Patent [19]

Sieling et al.

[11] Patent Number: 6,058,670

[45] Date of Patent: May 9, 2000

[54] LAMINATED ROOFING AND SIDING SHINGLE

[75] Inventors: Frederick W. Sieling, Bound Brook; Alfredo A. Bondoc, Somerset; William R. Carroll, Sussex, all of N.J.

[73] Assignee: Building Materials Corporation of America, Wayne, N.J.

[21] Appl. No.: 09/173,406

[22] Filed: Oct. 15, 1998

[51] Int. Cl.[7] ..... E04D 1/28; E04D 1/22; E04D 5/00

[52] U.S. Cl. ..... 52/554; 52/555; 52/557; 52/559

[58] Field of Search ..... 52/554, 555, 557, 52/559, 518, 553

[56] References Cited

U.S. PATENT DOCUMENTS

| | | | |
|---|---|---|---|
| 1,913,836 | 6/1933 | Hamlin | 52/559 |
| 2,162,886 | 6/1939 | Hamlin | 52/554 X |
| 4,717,614 | 1/1988 | Bondoc et al. | 52/553 X |
| 5,181,361 | 1/1993 | Hannah et al. | 52/554 X |
| 5,660,014 | 8/1997 | Stahl et al. | 52/559 X |
| 5,853,858 | 12/1998 | Bondoc | 52/554 X |

*Primary Examiner*—Christopher T. Kent
*Attorney, Agent, or Firm*—Marilyn J. Maue; William J. Davis

[57] ABSTRACT

The present invention relates to a laminated roofing and siding shingle unit including (a) a rectangular shingle sheet having an undivided headlap portion and a lower butt portion divided into tabs of a given color which are uniformly spaced from each other, each tab having two opposing bottom corners defining the bottom boundary of the butt portion and (b) an elongated undivided top strip of the same or a contrasting hue or color having indentations at its bottom edge conforming in outline to the corners of the tabs, said strip affixed over the shingle sheet at the upper tab boundaries where the tabs depend from the headlap and positioned in an offset manner so that each indentation corresponding to a corner of a tab is centered above the tab immediately below.

24 Claims, 7 Drawing Sheets

LAMINATED ROOFING AND SIDING SHINGLE

BACKGROUND OF THE INVENTION

Figure 1C:
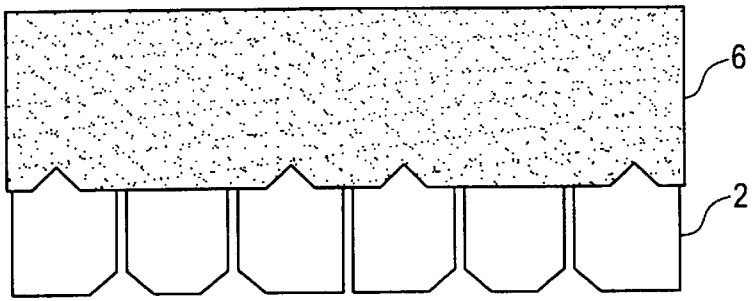

Building material shingles comprising a fiberglass mat, organic or inorganic felt or fabric stock impregnated with asphalt and surface covered with weather resistant mineral granules are well known. For the most part these shingles have been offered as relatively inexpensive alternatives to more costly tile, slate and wood shake roofing coverings. Very little attention has been directed to development of a shingle which does not imitate tile, slate or shake counterparts but which is aesthetically pleasing in its own right when installed on a roof or siding surface. It is desirable that such shingles retain the strength, fire resistance and weatherability of current shingles while creating a distinctive, attractive appearance. Accordingly, it is an object of this invention to provide such a unique shingle which can be commercially and economically manufactured using standard equipment.

THE INVENTION

The present invention relates to a laminated roofing and siding shingle unit including (a) a rectangular shingle sheet having an undivided headlap portion and a lower butt portion divided into tabs of a given color which are uniformly spaced from each other, each tab having two opposing bottom corners defining the bottom boundary of the butt portion and (b) an elongated undivided top strip of the same or a contrasting hue or color having indentations at its bottom edge conforming in outline to the bottom corners of a tab, said strip affixed over the shingle sheet at the upper tab boundaries where the tabs depend from the headlap and positioned in an offset manner so that each indentation corresponding to a corner of a tab is centered above the tab.

Generally, the shingle sheet has a length of from about 24 to about 48 inches and a width of from about 10 to about 22 inches; preferably a length of from about 36 to about 40 inches and a width of from about 12 to about 17 inches. The tabs in the butt portion have a vertical extension from the headlap of from 4 to 10 inches; more desirably 5 to 7.5 inches. The breadth of each tab can be varied between about 3 and about 12 inches; more desirably between about 4 and about 8 inches.

The butt portion of instant composite shingle contains 3 to 10 tabs, which are uniformly spaced apart between about 0.25 and about 2.00 inches; preferably between about 0.5 and about 1.00 inches. The individual tabs of the present composite shingles can be similar or dissimilar in shape and/or breadth and/or extension as shown in the accompanying drawings. Further, the bottom edges of the tabs can be curved or straight and the tab corners can be crimped or can be formed by right, obtuse or acute angles or any combination thereof as illustrated herein. The tabs of the butt portion have a given average color value which is contrasted, i.e. lesser or greater, than that of the top strip. Although shading within at least one of the tabs may be employed, an average color is observed and a color deviation between the strip and the sheet is visible.

The elongated top strip which overlays the headlap and is positioned above the tabs of the shingle sheet is of the same or, preferably of a distinguishable hue or color, and is secured to the headlap by conventional means which includes nailing and adhesive attachment. Additional adhesive can also be applied under the tabs for secure anchoring between courses of shingle units upon installation.

Generally, the width of the top strip is equal to or up to about 2.5 inches less than that of the headlap and is preferably equal to the headlap portion. The width of the butt portion can be equal to that of the headlap but is preferably narrower and has a width of 1.25 to 4 inches less than the width of the headlap. In the present invention, to achieve the unique appearance herein described, it is desirable that the lower edge of the elongated top strip duplicates or mirrors the sequence of the lower edge irregular corners of the tabs so as to allow for a uniform strip border surrounding each tab upon installation. It is to be understood, however that the lower strip border can be lengthened or shortened at the bottom of the tabs by adjusting the placement of successive shingle units between courses in an overlapping manner.

The top strip is attached to the shingle sheet in an offset manner so that its indentations mirroring the tab corners are positioned in the middle of these tabs having both corners crimped or rounded. Upon the installation of courses, the tabs of the successive unit are placed above the first unit where their corners mate with the indentations of the strip of the preceding course.

In a more preferred embodiment of the invention, the leading and trailing edges of the top strip are alternately notched to accommodate secure locking lateral placement in a row of shingle units. Desirably, the notch indentation and mateable notch extension at the strip edges are equal to 0.5 the distance between the tabs so that, when the shingle units are installed in series, the trailing edge of one shingle abuts the leading edge of the next shingle and a uniform spacing between the tabs of both shingle units is maintained. In a broader concept however, it is within the scope of this invention to have the leading and trailing side edges of the top strip and shingle sheet coextensive. In a more preferred embodiment, the tabs are of equal height and are shaped by crimped or rounded and right angled corners and color or hue of the top strip, is substantially contrasted with that of the sheet so as to provide a color distinguishable, uniform border or frame around each tab side and bottom edge when the shingle sheets are installed in courses.

In another preferred embodiment of the invention, one adjacent pair of tabs in the butt portion of the shingle sheet has facing right angled corners and outer crimped or rounded corners and said pair is adjacent to tabs having both corners crimped or rounded. In this case, the bottom edge of the top strip has indentations only where a tab corner is crimped or rounded and the strip is positioned so that the indentation corresponding to the crimped or rounded corners is centered above said pair of tabs having facing right angled corners and the bottom edge of the strip having no indentation, corresponding to the right angled corners, is centered above the tabs having both corners crimped or rounded which are adjacent said pair of tabs. This example of irregularly shaped tabs provides a particularly pleasing, non-geometric and aesthetically attractive appearance when installed on a roof.

As indicated above, the present shingles are installed in overlapping courses, where the tabs of one successive course cover the top strip portion of the preceding shingle, except for an exposeable lower margin, preferably equal to the spacing between tabs, and the tabs of the successive course mate with the indentations at the bottom of the top strip in the preceding course. The surfaces of the shingle sheet and the top strip carry weather resistant granules at least in their exposed areas.

The present shingle provides several advantages. Primarily, it allows the roofer to vary the depth of the top strip exposure when installing courses to satisfy the preference of the consumer. Secondly, by the use of contrasting hues or colors on different planes, there is created the illusion of varied thicknesses reminiscent of more expensive roofing. This illusion of varied thickness is further promoted when the top strip has a lighter color value than the color value of the overlaying tabs of a successive course since the positioning of the second shingle unit creates a sharp dark line delineating the tab outline against the lighter color of the strip. Thirdly, the present shingle protects against displacement of the strip layer since the strip affixed to the headlap portion can be nailed to the roof deck as opposed to prior laminates where the strip underlies the tabs and only a small margin of the headlap permitting attachment only with adhesive. This advantage is particularly important in locations subject to severe changes in temperature which may cause adhesive to crack or soften. Additionally, where the strip covers the entire headlap portion, better resistance to weathering is achieved due to a three layer coverage over the roof surface when installed. Many other functional as well as aesthetic advantages will become apparent to the roofer from the present disclosure.

Having generally described the invention, reference is now had to the drawings which illustrate preferred embodiments but which are not to be construed as limiting to the scope of the present invention as defined by the appended claims.

The following figures are shown in top plan view.

The darkening of the top strip in the following Figures is intended only to indicate a color contrast with respect to the tabs of the shingle sheet and does not indicate lightness or darkness in the color of the strip. The contrast can be achieved with a top strip of lighter or darker hue or a different color from that of the tabs depending on the option of the consumer. Of course it is to be understood that a top strip of the same color or hue as that of the tabs can be employed without departing from the scope of the present invention.

Figure 1A:
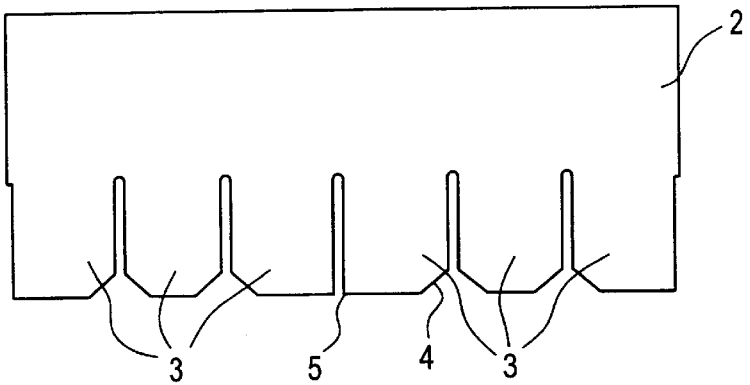
Figure 1B:
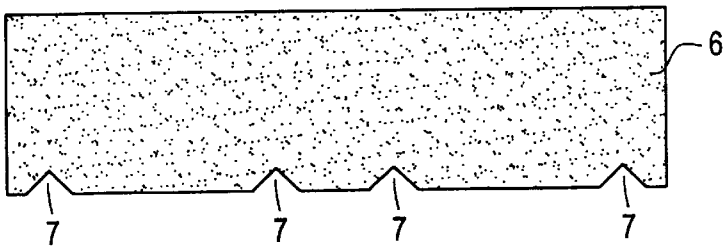

FIG. 1 is a first embodiment of the present composite shingle wherein I*a* is non-assembled shingle sheet 2 having tabs 3 with crimped and right angled bottom corners 4 and 5. FIG. 1*b* is the unattached top strip 6 which is associated with shingle sheet 2, whose bottom edge conforms with the crimped bottom edge corners of tabs 3 by indentations 7. FIG. 1*c* is an exposeable surface view of assembled sheet 2 attached to backup strip 6.

Figure 2:
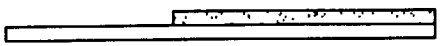

FIG. 2 is a side view of the shingle units shown in FIGS. 4–9.

Figure 3:
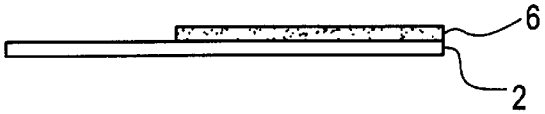

The following changes to the drawings have been approved by the examiner and agreed upon by applicant:

FIG. 3 is a side view of shingle unit I*c* with top strip adhesively attached to shingle sheet 2.

Figure 4C:
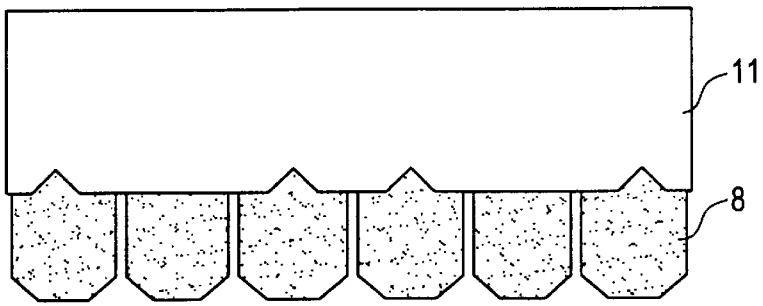
Figure 4A:
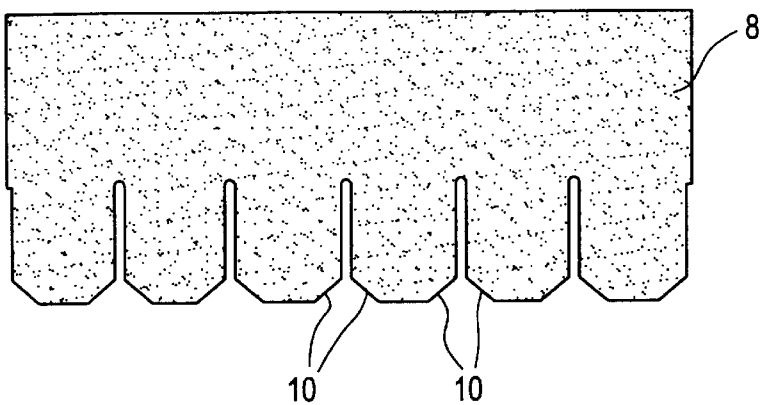
Figure 4B:
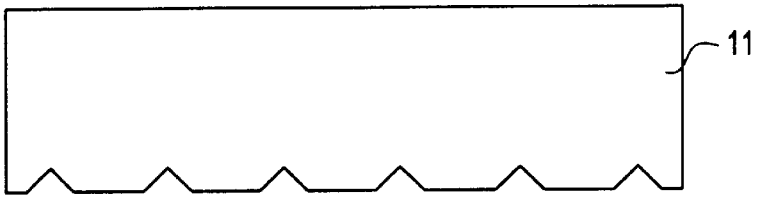

FIG. 4 represents a second embodiment of the invention wherein 4*a* shows shingle sheet 8 having tabs 10 of uniform size and shape with crimped tab bottom corners. FIG. 4*b* is the unattached top strip 11 which is associated with shingle sheet 8 and is suitably mounted above tabs 10 as shown in the composite shingle of FIG. 4*c*.

Figure 5C:
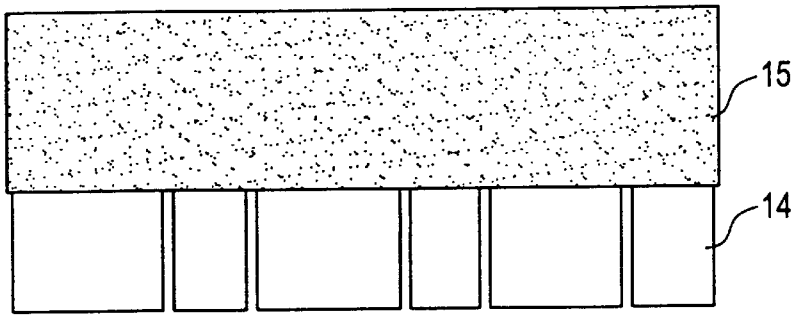
Figure 5B:
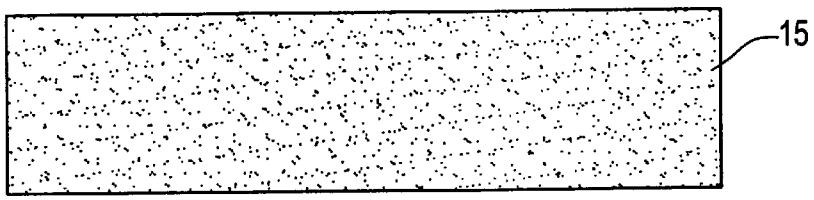
Figure 5A:
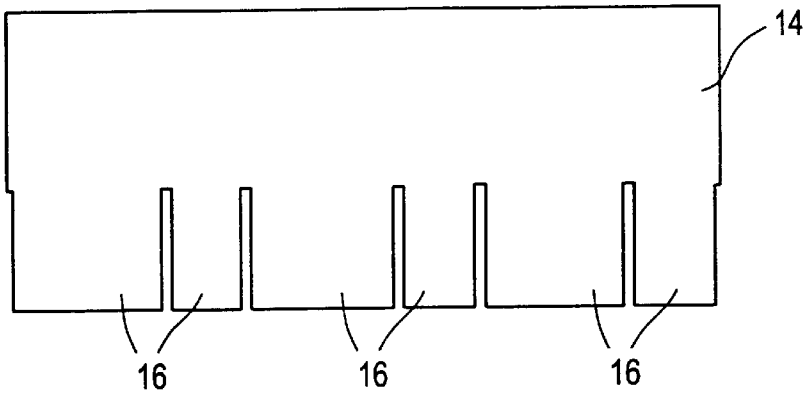

FIG. 5 illustrates a third embodiment of the present shingle wherein 5*a* shows shingle sheet 14 having rectangular tabs 16 of varying breadth. FIG. 5*b* shows top strip 15 which is associated with sheet 14 and which is suitably mounted above tabs 16 as shown in FIG. 5*c*.

Figure 6C:
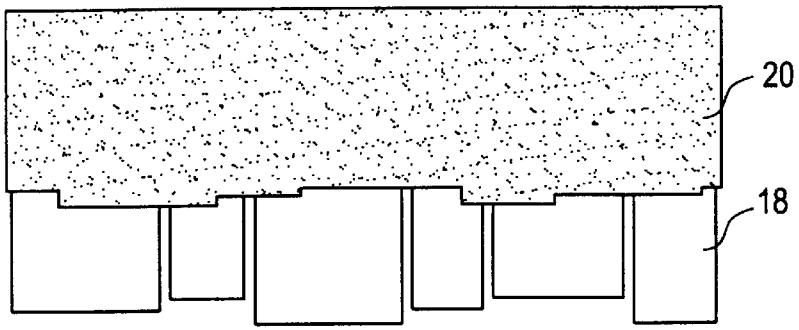
Figure 6B:
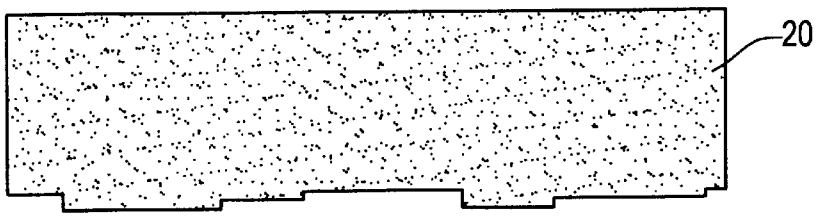
Figure 6A:
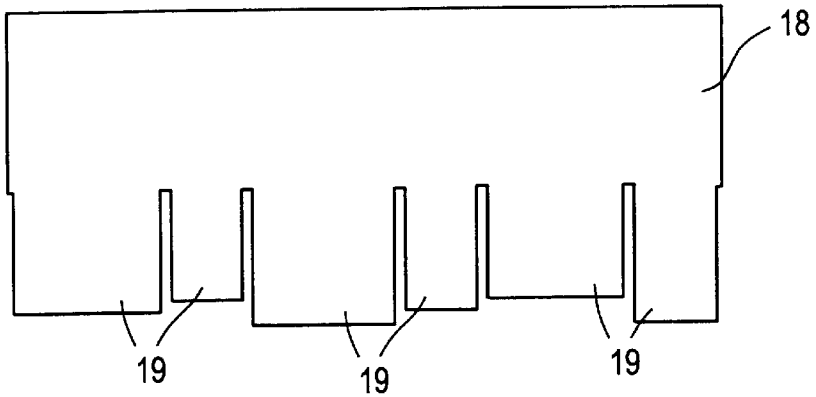

FIG. 6 shows a fourth embodiment wherein 6*a* is non-assembled shingle sheet 18 having rectangular and square tabs 19 of different extensions. FIG. 6*b* pictures detached top strip 20 which is associated with sheet 18 and which is suitably mounted above tabs 19 as shown in the composite laminated shingle of FIG. 6*c*.

Figure 7C:
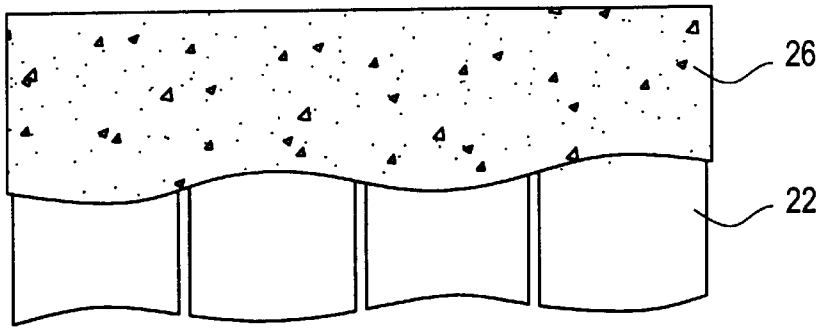
Figure 7B:
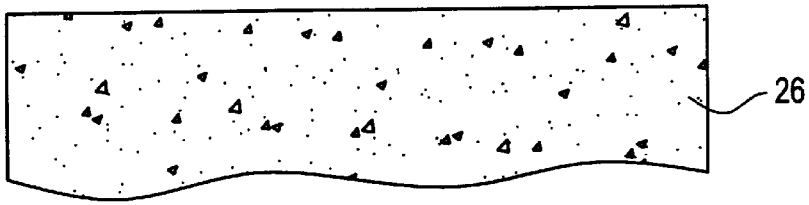
Figure 7A:
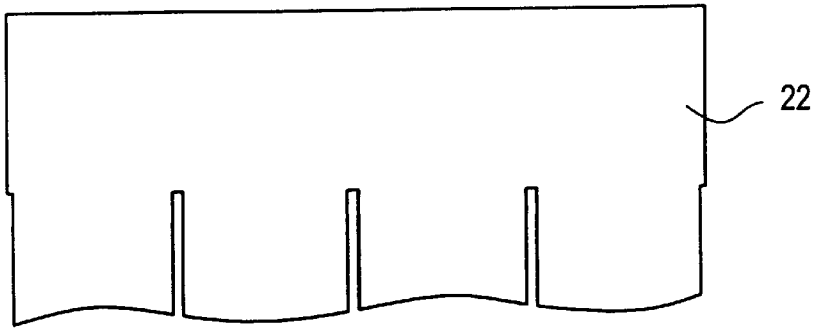

FIG. 7 illustrates a fifth embodiment wherein 7*a* is non-assembled shingle sheet 22 having tabs 24 defined with curved-bottom edges to provide a wavy horizontal line. FIG. 7*b* shows detached top sheet 26 which is associated with sheet 22 and which is suitably mounted above tabs 24 as shown in FIG. 7*c*.

Figure 8C:
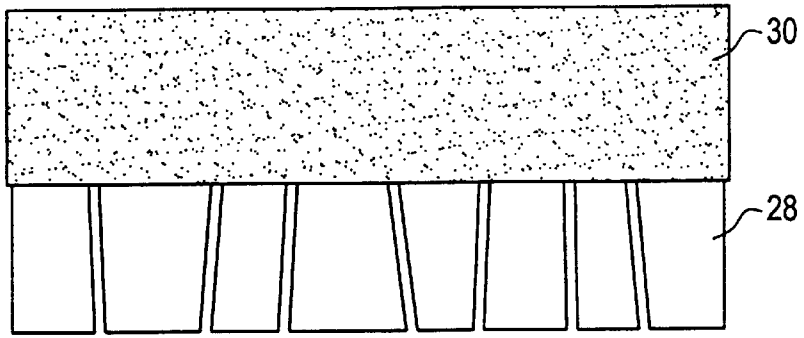
Figure 8A:
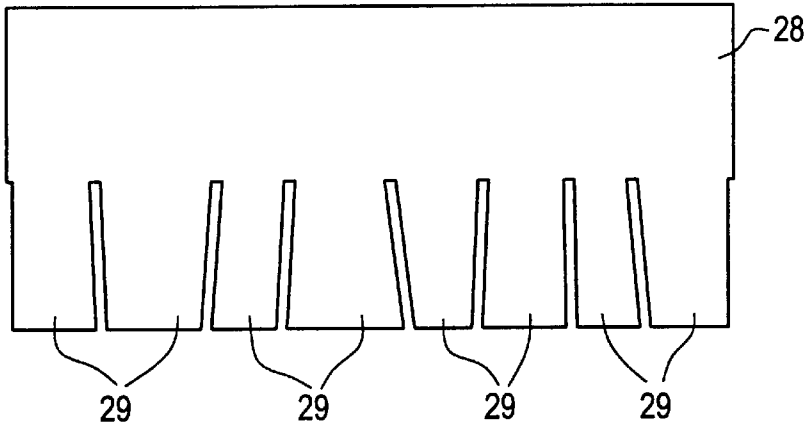
Figure 8B:
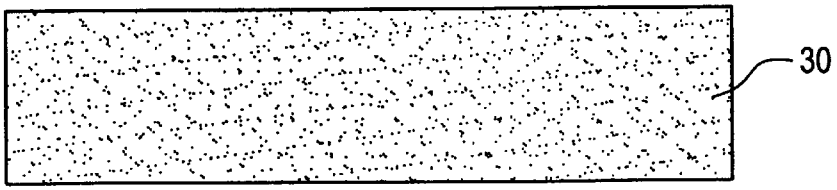

FIG. 8 shows still another embodiment of the present composite laminated shingle wherein 8*a* is non-assembled shingle sheet 28 having tabs 29 with acute and obtuse angled bottom corners. FIG. 8*b* is detached top strip 30 which is associated with sheet 28 and is suitably mounted above tabs 29 as shown in FIG. 8*c*.

Figure 9C:
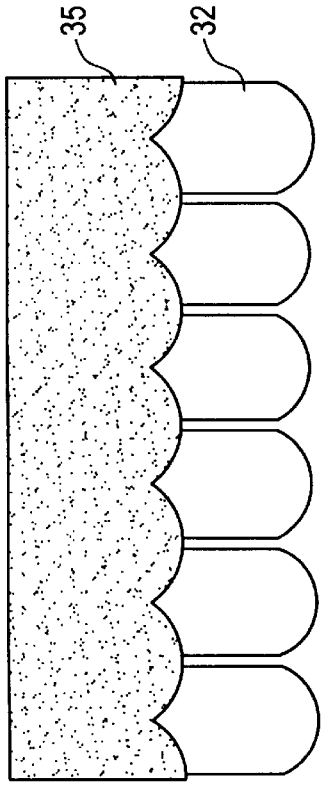
Figure 9B:
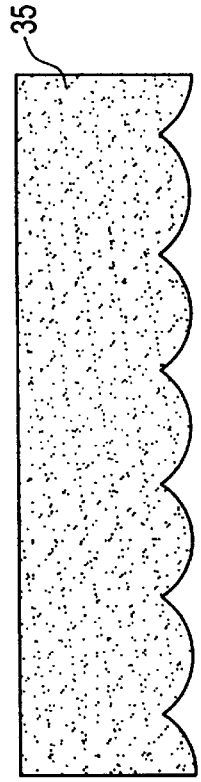
Figure 9A:
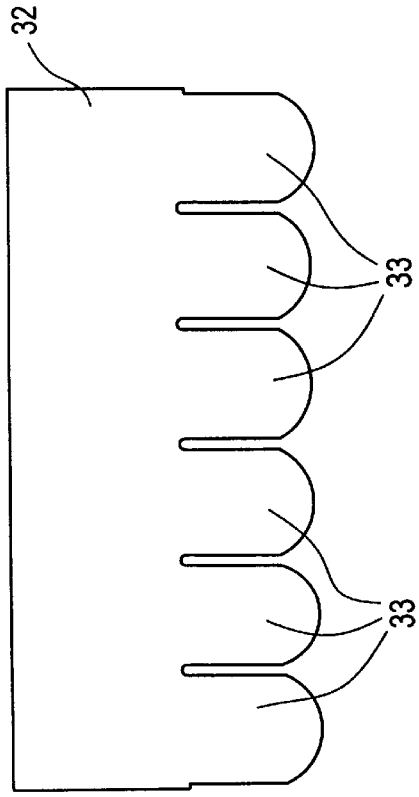

FIG. 9 illustrates yet another embodiment wherein 9*a* is non-assembled shingle sheet 32 having uniformly shaped tabs 33 with rounded edge bottom corners. FIG. 9*b* shows top strip 35 associated with sheet 32 which is suitably mounted above tabs 33 as shown in the composite laminated shingle of FIG. 9*c*.

The side views of all embodiments IV through IX inclusive are identical to that shown in FIG. 3.

Many other embodiments are within the scope of this invention and will become apparent from the foregoing disclosure.

What we claim is:

1.In a laminated roofing and siding shingle unit containing a rectangular shingle sheet having an upper undivided headlap portion and a lower butt portion divided into uniformly spaced tabs of a given average color, each tab having two opposing terminal corners defining the bottom boundary of the butt portion, the improvement which comprises: an elongated undivided top strip having indentations along its bottom edge conforming in outline to the bottom boundary and corners of the tabs, said strip laminated over the surface of the sheet headlap and positioned at the tab upper boundaries where the tabs depend from said headlap and situated so that the indentations of the strip are located above the tabs at approximately the midpoint of their widths.

2. The shingle unit of claim 1 wherein at least one tab of the butt portion has bottom corners which are not right angled and wherein said strip has indentations conforming in outline to each of the non-right angled bottom corner of each tab.

3. The shingle unit of claim 1 wherein said strip is of a color or hue which is visually distinguishable from the average color of said tabs.

4. The shingle unit of claim 3 wherein said strip is darker than said tabs.

5. The shingle unit of claim 3 wherein said strip is lighter than said tabs.

6. The shingle unit of claim 1 wherein the strip is of the same color as that of said tabs.

7. The shingle unit of claim 1 wherein the height of said tabs is optionally varied between about 4 and about 8 inches.

8. The shingle unit of claim 7 wherein said tabs are of the same height.

9. The shingle unit of claim 1 wherein the breadth of the tabs is optionally varied between about 3 and about 10 inches.

10. The shingle unit of claim 9 wherein said tabs are of equal breadth.

11. The shingle unit of claim 1 wherein the butt portion contains 6 tabs.

12. The shingle unit of claim 1 wherein at least one tab of the butt portion has a shaded color gradation.

13. The shingle unit of claim 12 wherein the color or hue of said strip deviates from the average color of each tab.

14. The shingle unit of claim 1 wherein the width of the headlap is between about 24 and about 48 inches and said strip is not more than 2.5 inches less than that of the headlap.

15. The shingle unit of claim 14 wherein the width of the headlap and the strip are equal.

16. The shingle unit of claim 1 wherein the width of the butt portion is not more than 4 inches less than that of the headlap.

17. The shingle unit of claim 16 wherein the width of the butt portion is approximately equal to that of the headlap portion.

18. The shingle unit of claim 1 wherein the tabs at the leading and trailing edges of the butt portion are inset by a distance of 0.5 the distance between the tabs in the shingle sheet unit.

19. The shingle unit of claim 1 wherein said strip is notched at its respective leading and trailing edges so that the trailing edge of said shingle unit is mateable with the leading edge of a successive shingle unit.

20. The shingle unit of claim 11 wherein the middle pair of tabs have facing right angled corners and outer crimped or rounded corners and the tabs adjacent to said pair have both edges crimped or rounded.

21. The shingle unit of claim 20 wherein said strip has indentations conforming in outline to the crimped or rounded corners of said tabs and is positioned over the shingle sheet so that the midpoint of said indentations is centered above the pair of tabs having right angled corners.

22. The shingle unit of claim 21 wherein said strip is of a color or hue which is visually distinguishable from the average color of said tabs.

23. The shingle unit of claim 22 wherein said strip surface is shaded from dark to light in a given color which differs from the shade on color of said tabs.

24. A roof covering comprising shingle units of any one of claims 1, 2 and 3.

* * * * *